US011525279B2

(12) United States Patent
Wennberg

(10) Patent No.: US 11,525,279 B2
(45) Date of Patent: Dec. 13, 2022

(54) HANDLE DEVICE

(71) Applicant: ASSA ABLOY OPENING SOLUTIONS SWEDEN AB, Eskilstuna (SE)

(72) Inventor: Rikard Wennberg, Gothenburg (SE)

(73) Assignee: ASSA ABLOY OPENING SOLUTIONS SWEDEN AB, Eskilstuna (SE)

( * ) Notice: Subject to any disclaimer, the term of this patent is extended or adjusted under 35 U.S.C. 154(b) by 841 days.

(21) Appl. No.: 16/331,994

(22) PCT Filed: Sep. 21, 2017

(86) PCT No.: PCT/EP2017/073905

§ 371 (c)(1),
(2) Date: Mar. 11, 2019

(87) PCT Pub. No.: WO2018/055035

PCT Pub. Date: Mar. 29, 2018

(65) Prior Publication Data

US 2019/0360236 A1 Nov. 28, 2019

(30) Foreign Application Priority Data

Sep. 23, 2016 (EP) ..... 16190410

(51) Int. Cl.
*E05B 13/00* (2006.01)
*E05B 47/00* (2006.01)
*E05B 47/06* (2006.01)

(52) U.S. Cl.
CPC ..... *E05B 13/004* (2013.01); *E05B 13/005* (2013.01); *E05B 47/0012* (2013.01);
(Continued)

(58) Field of Classification Search
CPC ..... E05B 13/00; E05B 13/002; E05B 13/004; E05B 13/005; E05B 13/10; E05B 13/101;
(Continued)

(56) References Cited

U.S. PATENT DOCUMENTS 1,402,104 A * 1/1922 Soss ..... E05B 13/108 70/216
1,779,438 A * 10/1930 Lowe ..... E05B 13/101 70/222

(Continued)

FOREIGN PATENT DOCUMENTS

CH 712591 A2 * 12/2017 ..... E05B 13/101
DE 29603652 6/1997

(Continued)

OTHER PUBLICATIONS

Office Action for CN Counterpart Application No. 201780058619.X, dated Jul. 1, 2020, China National Intellectual Property Administration, Beijing, China.

(Continued)

*Primary Examiner* — Alyson M Merlino
(74) *Attorney, Agent, or Firm* — Sheridan Ross P.C.

(57) ABSTRACT

Handle device for operating doors, windows and the like. The handle device comprises a first element (3, 103), which is rotatable about an axis of rotation, a second element (8, 108), and a coupling device (10, 110) which is arranged to selectively allow and prevent relative rotation about the axis of rotation between the first and the second element. The coupling device comprises a first coupling member (11, 111) which is connected to or forming an integral part of the first element. A second coupling member (12) is connected to or forming an integral part of the second element (112). At least one engaging member (13, 13, 113, 114) is movable between an engagement position in which it simultaneously engages the first and the second coupling members to thereby prevent (Continued)

relative rotation between the first and second element and a release position in which it is disengaged from at least one of the first and second coupling members to thereby allow relative rotation between the first and second element. An actuator (22, 122) is arranged to move the engaging member between the engagement position and the release position. The engaging member (13, 14, 113, 114) is pivotally mounted to the first coupling member (11,111) and arranged to pivotally move between the engagement position and the release position.

11 Claims, 7 Drawing Sheets

(52) U.S. Cl.
CPC ..... *E05B 47/0669* (2013.01); *E05B 47/0688* (2013.01); *E05B 2047/0023* (2013.01); *E05B 2047/0094* (2013.01)

(58) Field of Classification Search
CPC ..... E05B 13/106; E05B 13/108; E05B 1/00; E05B 1/0007; E05B 1/003; E05B 47/0657; E05B 47/0665; E05B 47/0669; E05B 47/0676; E05B 47/0684; E05B 47/0688; E05B 55/005; Y10T 292/57; Y10T 292/82; Y10T 292/85; Y10T 292/873; Y10T 292/93; Y10T 292/96
See application file for complete search history.

(56) References Cited

U.S. PATENT DOCUMENTS 1,899,686 A * 2/1933 Vander Henst ..... E05B 13/101 70/222
1,899,996 A * 3/1933 Sullivan ..... E05B 13/108 70/216
1,899,997 A * 3/1933 Sullivan ..... E05B 13/101 292/357
2,529,230 A * 11/1950 Smith ..... E05B 55/005 292/169.18
6,014,878 A * 1/2000 Shen ..... E05B 13/101 70/222
6,895,791 B2 5/2005 Alexander
2013/0015671 A1 * 1/2013 Calleberg ..... E05B 47/0673 292/144

FOREIGN PATENT DOCUMENTS

DE 10032998 A1 * 12/2001 ..... E05B 47/0615
DE 102015007872 B3 * 11/2016
EP 3922787 A1 * 12/2021 ..... E05B 13/004
FR 2776696 10/1999
GB 191217080 A * 1/1913
GB 2263498 7/1993
KR 20100008050 U * 8/2010
WO 2009078800 6/2009
WO 2011119097 9/2011
WO 2015052102 4/2015

OTHER PUBLICATIONS

Office Action for EA Counterpart Application No. 201990692/ 31, dated Mar. 17, 2020, Eurasian Patent Office, Moscow, Russia.
International Search Report and Written Opinion for International (PCT) Patent Application No. PCT/EP2017/073905, dated Dec. 6, 2017, 12 pages.
International Preliminary Report on Patentability for International (PCT) Patent Application No. PCT/EP2017/073905, dated Aug. 29, 2018, 12 pages.
Extended Search Report for European Patent Application No. 16190410.7, dated Mar. 20, 2017, 8 pages.

* cited by examiner

HANDLE DEVICE

FIELD OF THE INVENTION

The invention relates generally to a handle device for operating doors, windows, gates, hatches and the like. The invention relates in particular to such a handle device comprising a first element, which is rotatable about an axis of rotation, a second element, and a coupling device for selectively allowing or preventing relative rotation about the axis of rotation between the first element and the second element. The invention has a use, for example, on doors, windows, lockers, gates, hatches and the like that are to be able to be operated using some type of handle, for example a lever handle, a knob, a thumb turn or a handle of the window handle type.

BACKGROUND OF THE INVENTION

In many doors, windows and other such elements provided with a rotatable handle, it is desirable that a part that can be turned or rotated by means of the handle can be selectively coupled to or disengaged from another part. The other part can either be a similarly rotatable part or a stationary part.

When both parts are rotatable, it may be desirable in a disengaged position, for example, to allow the handle to be turned without affecting the other part and, in a coupled position, to allow a rotation movement of the handle to be transferred to the other part. The other part can then be, for example, a swivel pin, such as a handle shank or lever handle shank, which is in turn able to transfer the rotation movement to a follower, a bolt, an espagnolette, a lock or some other device for influencing the state of the door or of the window. In the coupled position, normal operation therefore occurs by way of the handle. In the disengaged position, by contrast, the state of the door or of the window remains unaffected if the handle is turned.

Disengagement of the handle from another rotatable part is sometimes referred to as "free swing". This kind of selective disengagement can be used, for example, as a child safety measure, in order to prevent an external door or a window from being opened from the inside, or in order to prevent damage to a lock or the like coupled to the handle if excessive forces are applied to the handle when the lock is in the locked position.

When the other part is a stationary, non-rotatable part, the rotatable handle can be conventionally fixed or continuously coupled by means of a handle shank or lever handle shank to a bolt, an espagnolette, or a lock, for example, or some other device for influencing the state of the door or the window. Disengagement and coupling between the rotatable handle and the stationary part can then be used, in the disengaged position, to allow operation and, in the coupled position, to block the handle and thereby prevent operation of the door or the window. The coupling between the handle and the stationary part can in this respect be said itself to constitute a lock. This kind of selective disengagement and coupling between the rotatable handle and the stationary part can be used as a child safety measure, for example, or in order to prevent unauthorized persons from operating a door or a window.

In both cases the disengagement and coupling between the rotatable handle and the other part can be achieved manually, for example by operating a mechanical button, a lock cylinder or the like. Recently, however, it has become increasingly more common to bring about this disengagement and coupling by electro mechanical means. This allows disengagement and/or coupling, for example, only when an authorized user has first entered a code via a keypad or has provided identification via a card reader for electronic cards, an RFID tag or the like.

PRIOR ART

WO 2009/078800 describes a handle device with which it is possible to selectively disengage and couple a first rotatable element and a second element. The first element can be, for example, a handle grip, and the second element can be a handle plate or escutcheon. The device comprises an inner coupling member and an outer coupling member and also an engaging member. By moving an activating member axially, it is possible for the engaging member to move radially for being placed in and removed from simultaneous engagement with the inner and outer coupling members. When the engaging member is in simultaneous engagement with both coupling members, relative rotation between them is prevented. When the engaging member is removed from simultaneous engagement, relative rotation of the two coupling members is permitted. Axial movement of the activating member is obtained manually or by means of an electrically driven solenoid.

WO 2011/119097 A1 describes a similar handle device for selectively allowing and preventing relative rotation between a first rotatable element and a second element. According to this document, axial movement of the activating member is achieved by means of an electrical motor with a rotational output shaft. As in WO 2009/078800 A1, the axial movement of the activating member is translated into a radial movement of engagement members for bringing these into ant out of simultaneous engagement with the first and second element.

WO2015/052102 A1 describes a further example of a handle device for selectively allowing and preventing relative rotation between a first rotatable element and a second element. At this handle device an axially displaceable drive member acts on at least on engaging member for bringing the engaging member into and out of simultaneous engagement with a first and a second coupling member. According to different alternatives the engaging member can be either radially or axially movable into and out of the simultaneous engagement.

SUMMARY OF THE INVENTION

An object of the invention is to provide an enhanced handle device which permits selective disengagement and coupling between a first rotatable element and a second element.

Another object is to provide such a handle device which is capable of sustaining comparatively high torques between the first and second element when coupled.

A further object is to provide such a handle device that can be configured with small dimensions and has a small axial and radial installation size.

Still another object is to provide such a handle device which is reliable in use.

A further object is to provide a handle device of this kind that requires low electrical energy.

Yet another object is to provide a handle device of this kind that has a high degree of safety and an improved ability to withstand unauthorized manipulation.

A further object is to provide a handle device of this kind that permits relatively simple electrical control.

Yet another object is to provide a handle device of this kind that has a high level of operating safety and a long lifetime.

Another object is to provide a device of this kind that is simple, with few movable parts, and yet permits very secure coupling between the two elements.

These and other objects are achieved by a handle device of the type that is specified in the introductory part of claim 1 and that has the special technical features specified in the characterizing part. The handle device is intended for operating doors, windows and the like. It comprises a first element, which is rotatable about an axis of rotation, a second element, and a coupling device which is arranged to selectively allow and prevent relative rotation about the axis of rotation between the first and the second element. A first coupling member is connected to or forms an integral part of the first element. A second coupling member is connected to or forms an integral part of the second element. At least one engaging member is movable between an engagement position in which it simultaneously engages the first and the second coupling members to thereby prevent relative rotation between the first and second element and a release position in which it is disengaged from at least one of the first and second coupling members to thereby allow relative rotation between the first and second element. An actuator is arranged to move the engaging member between the engagement position and the release position. The engaging member is pivotally mounted to the first coupling member and arranged to pivotally move between the engagement position and the release position.

The arrangement of the coupling device's first coupling member, second coupling member and the movable engagement member allows for a number of different configurations of the cooperating first and second elements. For instance, both the first and the second elements may be arranged rotatable, such that the coupling device, in the engagement position of the engagement member will transmit a rotational movement of the first element to the second element. In the release position, a rotational movement of the first element is not transmitted to the second element, such that a so called free swing mode is achieved. If the first element is connected to e.g. a handle, actuation of the handle will thus, in the engagement position, be transmitted to any locking member or the like being connected to the second element for actuation of the locking member. In the free swing mode, actuation of the handle will not be transmitted to the locking member such that the entire lock arrangement is inoperable or locked.

Alternatively, the second element could be stationary, i.e. fixable to a door, a window, a lock casing or the like. The rotational first element may then be operationally connected to, on the one hand a handle or the like and on the other hand to a plain spindle, a follower or some other means for the manoeuvring of e.g. a lock bolt, an espagnolette or some other locking member. In such a case, the rotational first element is prevented from rotating when the engagement member is in the engagement position, to thereby prevent manoeuvring of the locking member by actuation of the handle, such that the entire lock arrangement is locked. In the release position, the first element and the handle is allowed to rotate, such that the locking member may be manoeuvred by means of the handle and the entire lock arrangement is thereby un-locked.

Additionally, the arrangement of the at least one engagement member which is pivotally fixed to the first coupling member allows for a number of advantages. Firstly, pivotal arrangement of the engaging member allows the torque transmitting surfaces of the engagement member and of the first and second coupling members to be designed with comparatively large areas. By this means also high torques may be transmitted between the first and second coupling member without causing excessive load on the engagement member or on the first and second coupling member. Thereby wear is reduced and service life prolonged. The pivotal arrangement also allows for that the engagement member may be moved between the engagement position and the release position at comparatively low friction. This also reduces wear and allows for that a comparatively small force is needed for driving the engagement member. This in turn allows for the use of small and comparatively weak actuators with only low energy consumption.

A further advantage resides in that the pivotal movement of the engagement member allows the engagement member to be pivotally driven by means of a lever arm. For example, the pivotal motion of the engagement member may be driven by a linkage which connects the engagement member to a linearly operating actuator. The distance between the engagement member's pivotal axis and the connection point of the linkage to the engagement member will then constitute a moment arm. By choosing the length of this moment arm, i.e. said distance between the pivotal axis and the connection point, it is possible to drive the pivotal movement at different gear ratios. Thus, without the need of any additional components the coupling device may readily be adapted to different actuators that may vary in regard of e.g. available stroke and force generated by the actuator.

The handle device may comprise two engaging members which are mutually interconnected for synchronized movement between the engagement position and the release position. By this means it is sufficient for only one of the engagement members to be driven by the actuator.

The engagement members may e.g. be interconnected by means of cooperating gear teeth. This allows for a reliable synchronized movement of both engaging members at low friction.

The second coupling member may be received concentrically in the first coupling member. This allows for a space saving design.

The first coupling member may comprise a radially inner portion and a radially outer portion and at least a portion of the second coupling member may be received between said radially inner and outer portions. This provides a particular advantage since it results in that the engaging member, in the engagement position may engage the first coupling member both and a radial inner and a radial outer portion whereas it will engage the second coupling member at an radial intermediate portion. Upon a torque being applied to either the first or second coupling member, the dual contact with the first coupling members inner and outer portions will result in a balancing effect which prevents the engaging member from being canted or skewed. This in turn reduces the risk of jamming and malfunctioning. The dual contact also increases the total load bearing surfaces such that the load on the engaging member and the first coupling member is reduced.

The first coupling member may alternatively be received concentrically in the second coupling member. This may be particularly advantageous e.g. when the second coupling member is stationary, e.g. when it is constituted by or connected to a handle escutcheon or the like.

Each engagement member may exhibit two planar engagement surfaces, each engagement surface being arranged, in the engagement position, to make contact with at least one planar support surface of the first coupling member and at least one planar support surface of the second coupling member. This allows for an even distribution of the forces acting on the engagement member and the first and second coupling members.

The planar engagement surfaces and the planar support surfaces may be arranged parallel in the engagement position.

The first coupling member and the second coupling member may be rotational symmetrical.

The actuator may be a linear actuator and connected to at least one engagement member by means of a mechanical linkage arranged to translate a linear movement of the actuator to a pivotal movement of the engagement member. This allows for a space saving and energy efficient drive arrangement for the engaging member.

The actuator may comprise a drive unit chosen from the group of an electrical motor, a solenoid and a piezo electric element. In case where an electrical motor is used, it may be e.g. a traditional permanent magnet motor or a electro permanent magnet motor and it may be either rotational or linear.

The second element may be rotational and comprise or be connected to a spindle for manoeuvring a lock.

Alternatively, the second element may be stationary and comprise or be connected to a handle escutcheon.

Additional objects and advantages of the handle device appears from the following detailed description of exemplifying embodiments and from the appended claims.

BRIEF DESCRIPTION OF THE DRAWINGS

Below, a detailed description of exemplifying embodiments is given with reference to the attached drawings, in which.

DETAILED DESCRIPTION OF EXEMPLIFYING EMBODIMENTS

In this specification, the term handle refers to any type of manually manoeuvrable organ for operating a lock mechanism of a door, a window, a locker, a gate, a hatch or the like. Examples of such manually manoeuvrable organs are door handles, window handles, lever handles, thumb turns, knobs etc. Where not specified differently the terms axial, coaxial and radial refers to an axis of rotation by which the manually manoeuvrable organ may be rotated or pivoted.

In the attached drawings, FIGS. 1-4 illustrate a first embodiment of the invention comprising a first rotational element and a second element which is also rotational, wherein two engagement members are pivotally movable in and out of simultaneous engagement with the first and second element.

Figure 5B:
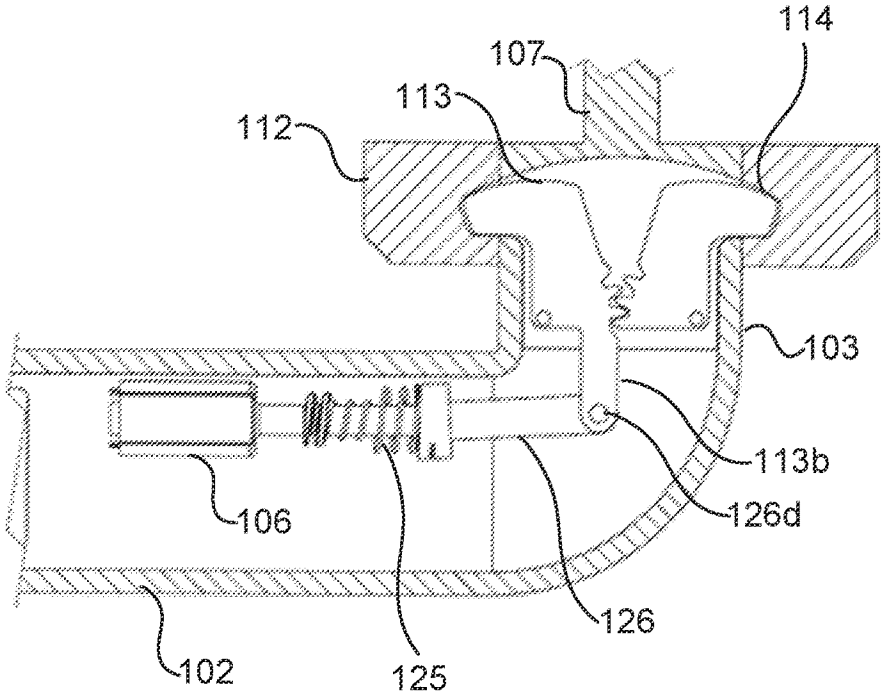
FIGS. 5*a* and 5*b* are sections corresponding to FIGS. 3*a* and 3*b* showing a handle device according to another embodiment of the invention.
Figure 5A:
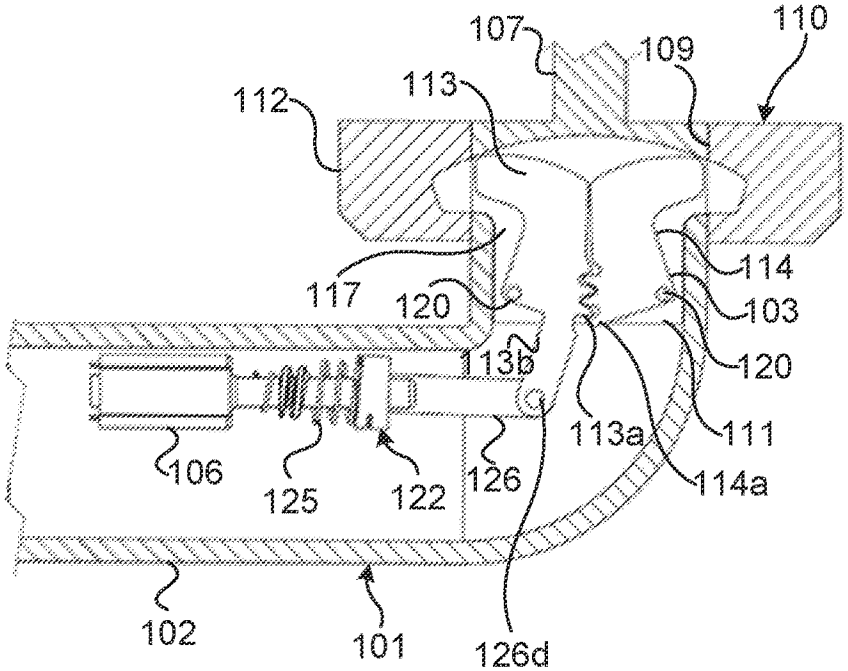
Figure 6:
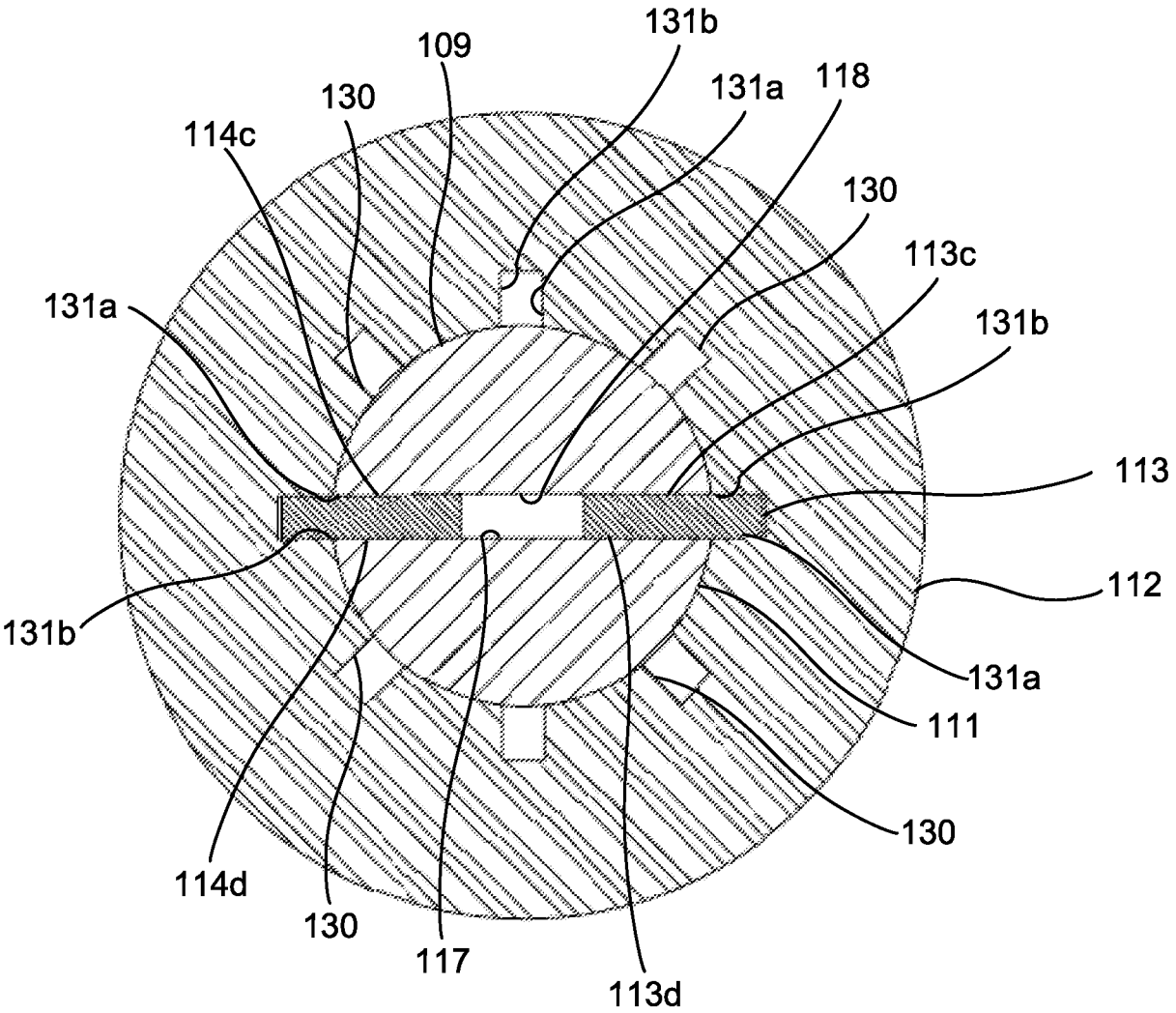
FIG. 6 is a cross section through a coupling device forming part of the handle device shown in FIGS. 5*a-b*.

FIGS. 5*a*-6 illustrate a second embodiment comprising a first rotational element and a second stationary element and wherein an engagement member is pivotally movable in and out of simultaneous engagement with the first and second element.

The handle device according to the first embodiment shown in FIGS. 1-4 comprises a manually operational door handle 1 comprising a manually manoeuvrable member 2 which is formed as a grip portion of the handle. A first rotational element 3 forming a cylindrical neck portion of the handle 1 is rigidly connected with the manoeuvrable member 2. The handle 1 and its first element 3 is rotatable about an axis of rotation which extends centrally through and concentrically with the first element 3. The handle 1 comprises two half members 1*a*, 1*b* defining an inner space. An electric circuit board 4 for verifying the authority of a person using the handle is received in the inner space of the handle 1. In the shown example, the circuit board 4 comprises an RFID reader which is able to remotely communicate at short distance with an RFID tag or the like carried by persons authorized to open the door. The RFID reader is electrically connected to an electrical control unit arranged on the circuit board 4, for verification of the authorisation code and control of an electrical motor 6, which will be described further below. An electrical battery (not shown) may be inserted in a battery cradle (not shown) which in turn may be inserted through the free end of the manoeuvrable member 2 and electrically connected to the circuit board for powering the RFID reader, the control unit and the motor 6.

The handle device 1 also comprises a second element 8, which in the shown example is a plain spindle having a square cross section and being arranged to be connected to a handle follower (not shown) connected to a lock bolt (not shown) of a door lock (not shown). The handle device further comprises a handle escutcheon 9 for fixing the handle device 1 to a door.

Figure 1A:
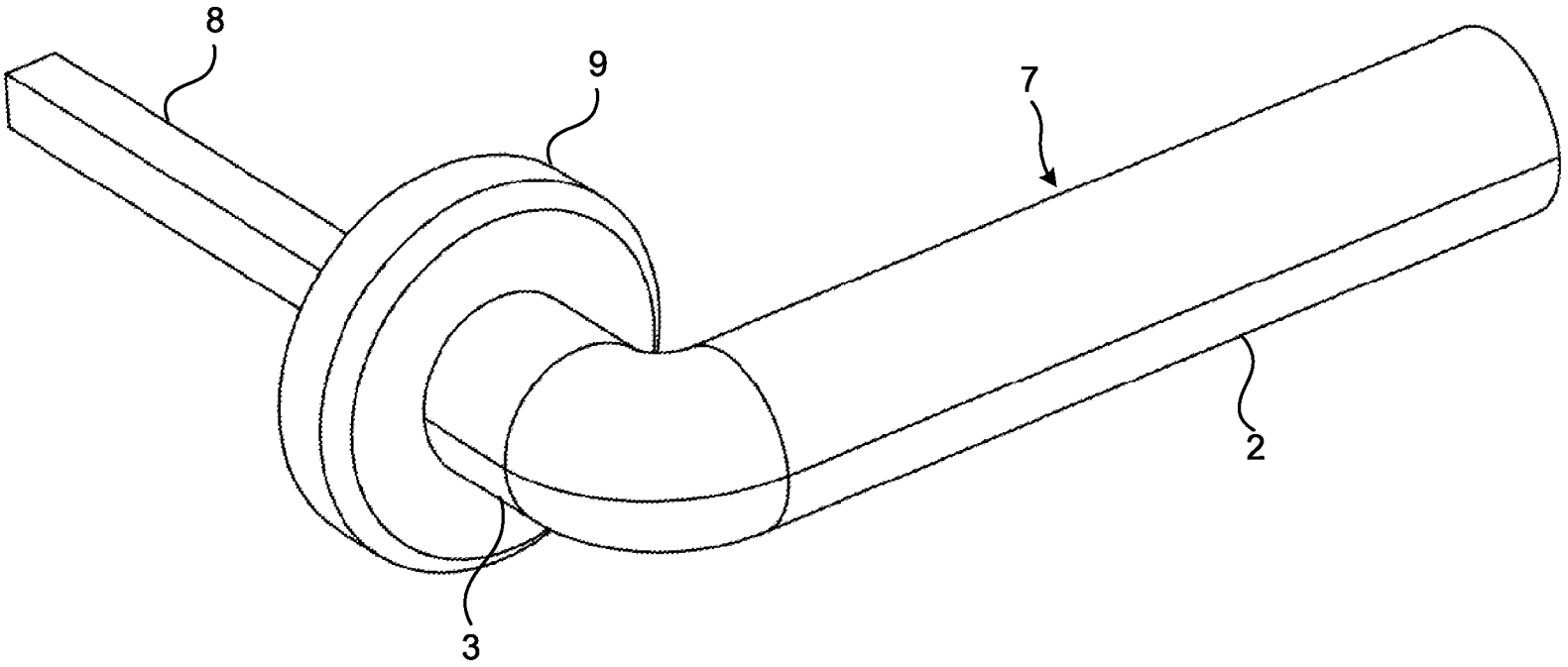
FIG. 1*a* is a perspective view of a handle device according to a first embodiment of the invention and FIG. 1*b* is an explode perspective view thereof.
Figure 1B:
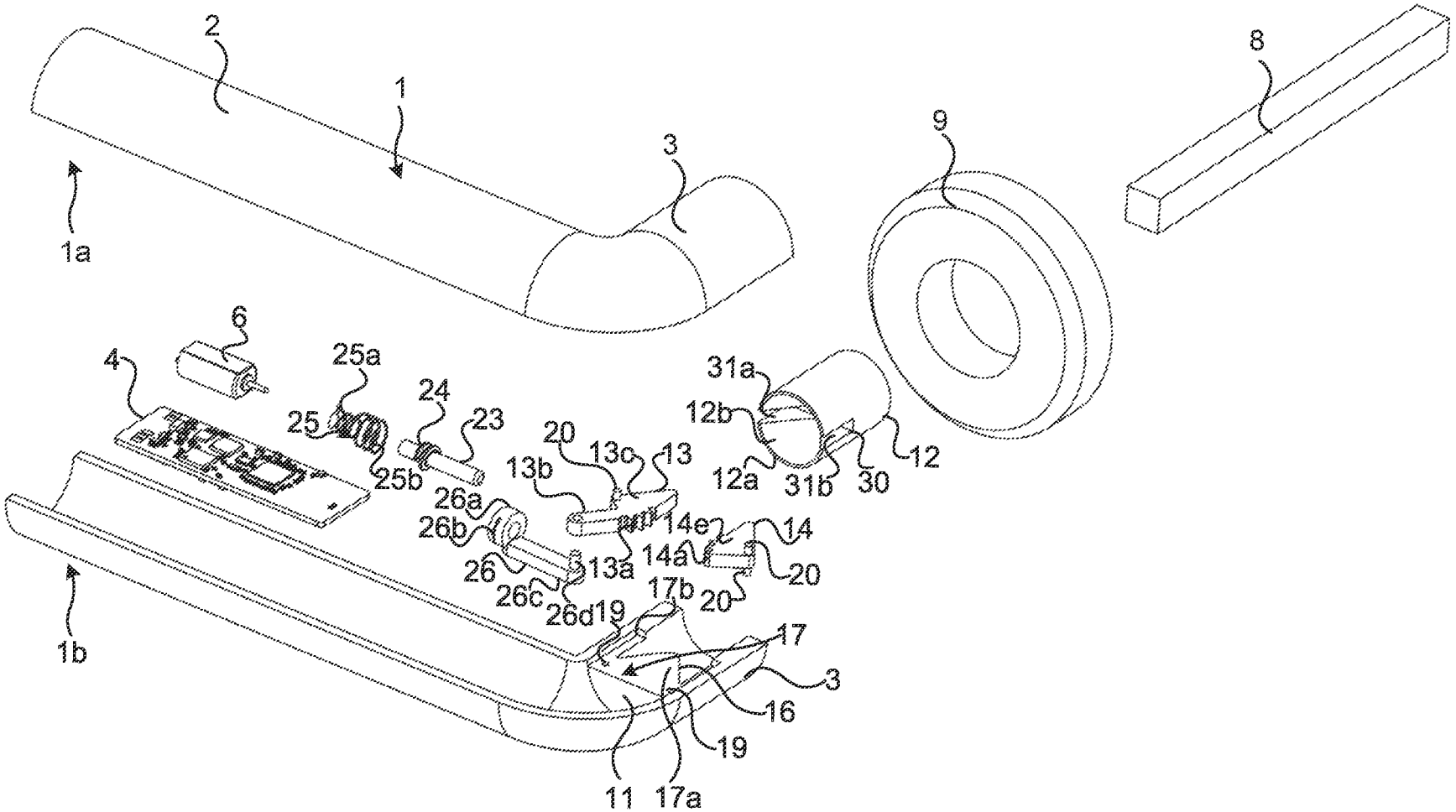
Figure 3B:
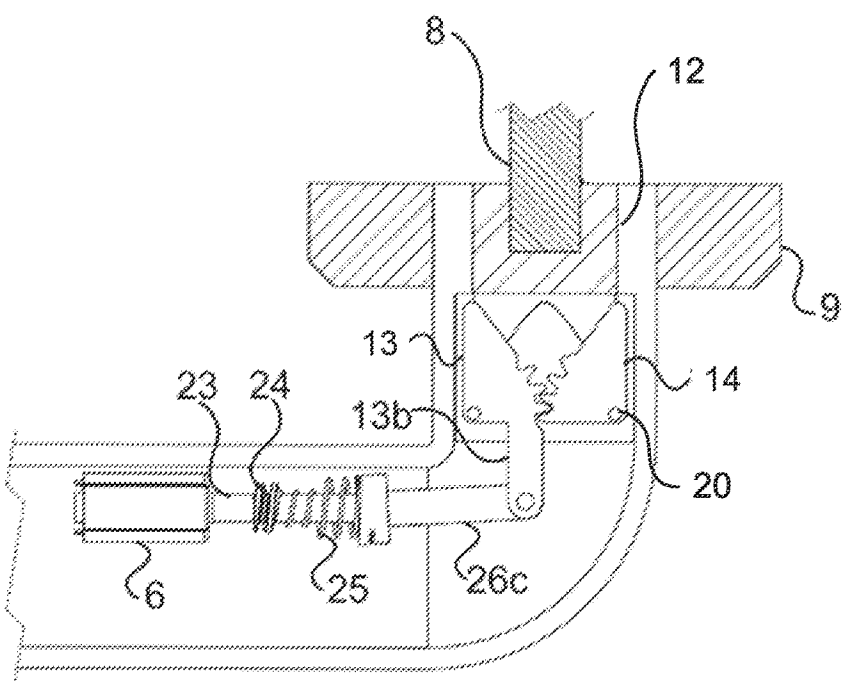
FIGS. 3*a* and 3*b* are sections of a portion of the handle device shown in FIGS. 1*a-b* and illustrate the engagement member in a release position and an engagement position respectively.
Figure 3A:
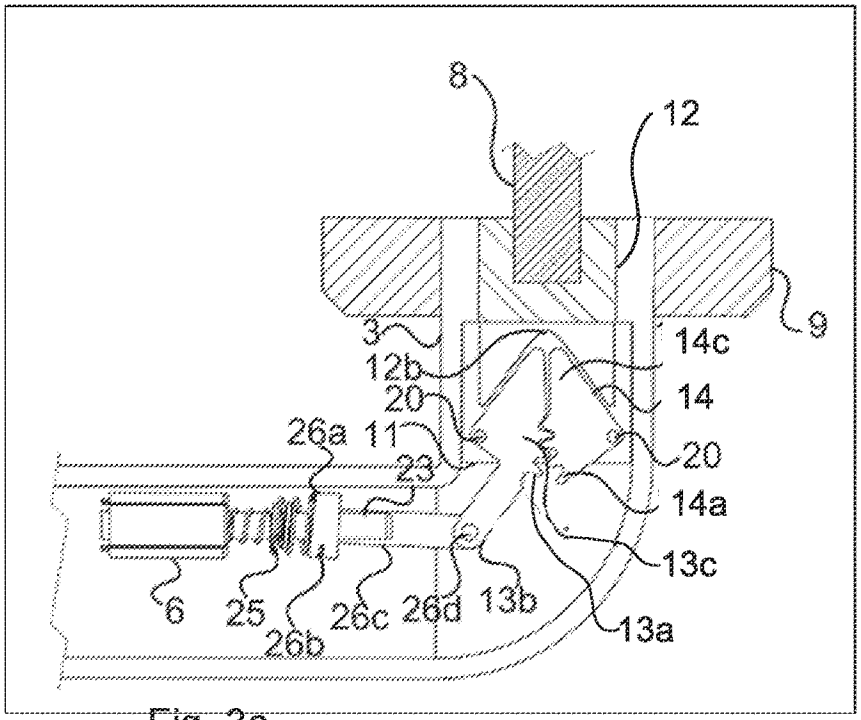

As best seen in FIG. 1*b*, the handle device further comprises a coupling device 10 for selectively connecting and disconnecting the handle 1 to and from the second element 8. The coupling device comprises a first coupling member 11, a second coupling member 12 and two engagement members 13, 14. The first coupling member 11 is formed integral with a first element 3 och the handle 1. The second coupling member 12 is connected to second element 8. As seen in FIGS. 3*a-b*, the connection between the second coupling member 12 and the second element 8 is realized by that an end portion of the second element 8 having square cross section is received in a recess with a corresponding square cross section formed in the second coupling member 12. By this means the second coupling member 12 is non-rotationally fixed to the second element 8, such that a rotational movement of the second coupling member 12 will be transmitted to the second element 8.

The first coupling member 11 is generally cylindrical having a cylindrical bore 15 open at one end. The opposing end is closed by a generally conical end wall 16 tapering toward the open end. In FIG. 1*b* only one half portion of the inner geometry of the first coupling member 11 is shown but it is readily understood that the upper half portion 1*a* of the handle comprises an identical half portion and that the two half portions together form the first coupling member 11. The conical end wall 16 exhibits a slit extending radially and axially in the first coupling member 11. The slit defines two first planar support surfaces 17, 18. The first planar support surfaces 17, 18 are arranged opposing each other and are each divided into a central portion 17*a*, 18*a* and two peripheral portions 17*b*, 18*b* (see FIG. 4).

The first coupling member 11 further exhibits four cylindrical recesses 19 forming pivot seats. A first 13 and a second 14 engagement member are pivotally fixed to the first coupling member 11. Each engagement member 13, 14 comprises a generally triangular planar portion having a thickness which corresponds to the width of the slit arranged in the first coupling member 11. The planar side surfaces of the engagement members 13, 14 constitutes planar engagements surfaces 13*c*, 13*d*, 14*c*, 14*d* which are arranged to make contact with corresponding support surfaces arranged at the first 11 and second 12 coupling member. Each engagement member 13, 14 also comprises two pivot shafts 20 protruding perpendicular from opposing planar sides of the engagements member's 13, 14 triangular portions. Each pivot shaft 20 is pivotally received in a respective pivot seat thereby allowing the engagement members 13, 14 to pivot about a respective pivot axis defined by the shafts 20 and in a plane which is parallel to the planar support surfaces 17, 18.

The engagement members 13, 14 exhibit means 13*a*, 14*a* for synchronizing the pivotal movement. In the shown example this means comprises cooperating gear teeth 13*a*, 14*a* arranged at opposing edges of the engagement members 13, 14. One of the engaging members 13 is further provided with a drive arm 13*b*, which extends perpendicular to the pivotal axis from an edge of the triangular portion.

An actuator 22 is connected to the first engagement member 13. The actuator 22 comprises A rotational shaft 23 fixed to an output shaft of the motor 6. The shaft 23 comprises a helical thread 24 which engages a helical drive spring 25. The spring 25 comprises a first section 25*a* which has a smaller diameter and a second portion 25*b* having a larger diameter. The first portion 25*a* is arranged to engage the thread 24 and the free end of the second portion 25*b* engages a circumferential slit 26*b* arranged in an annular portion 26*a* of a drive member 26. The drive member 26 further comprises an arm 26*c* extending from the annular portion 26*a* and provided with a linkage shaft 26*d*.

By driving the motor 6 in either rotational direction, the thread 25 drives, in threaded engagement with the spring's first portion 25*a*, the spring 25 to be linearly displaced in a corresponding direction. The spring's second portion thereby urges the drive member 26 in the same linear direction. During linear displacement of the drive member 26, its annular portion receives the shaft 23 and is guided thereby. However, the shaft 23 is received in the annular portion 26*a* with a certain play such that the drive member 26 and its arm 26*c* is allowed some angular variations with regard to the axial direction of the shaft 23.

The actuator 22 is connected to the coupling device 10 for pivotally moving the engagement members 13, 14. This connection is accomplished by means of the linkage shaft 26*d* being received in a cylindrical hole or recess arranged in the drive arm 13*b* of the first drive member 13. By this means the rectilinear distance between the pivotal axis of the engagement member 13 which axis is defined by the pivot shaft 20, and the hole or bore receiving the linkage shaft 26*d* defines a moment arm. By selecting different lengths of this moment arm it is possible to decide the gear ratio of the engagement member's 13 pivotal movement.

The second coupling member 12 is generally formed as a cylindrical sleeve having an open end 12*a* and an outer diameter which corresponds to the inner diameter of the bore 15 such that the second coupling member may be received in the first coupling member 11. The inner side wall 12*b* of the second coupling member 12 tapers conically inwards from the open end 12*a*. The conicity of the wall 12*b* corresponds to the conicity of the conical end wall 16 of the first coupling member 11, such that the conical wall end wall 16 is received in the second coupling member 12, when the second coupling member 12 is received in the bore 15 of the first coupling member 11.

A slit 30 is arranged through the circumferential wall of the second coupling member. The slit 30 extends from the open end 12*a*, through both opposing portions of the conical side wall 12*b* such that it forms two slit portions which are arranged in a common radial plane. The slit 30 thereby define four planar support surfaces 31*a*, 31*b*, 32*a*, 32*b*, where surfaces 31*a*, 31*b* opposes surfaces 32*a*, 32*b* respectively. The distance between surfaces 31*a*, 31*b* and surfaces 32*a*, 32*b* corresponds to the thickness of the engagement members 13, 14 such that the engagement members 13, 14 may be received between the surfaces 31*a*, 31*b* and surfaces 32*a*, 32*b* with a small play.

Even though not shown in the figures, the handle escutcheon and/or the handle comprises a spring or other means for returning the handle to a rotational starting position after the handle has been depressed. In the starting position the support surfaces 17*a*, 17*b* and 18*a*, 18*b* of the first coupling member 11 are aligned with the respective corresponding support surfaces 31*a*, 31*b* and 32*a*, 32*b* of the second coupling member 12.

Figure 2:
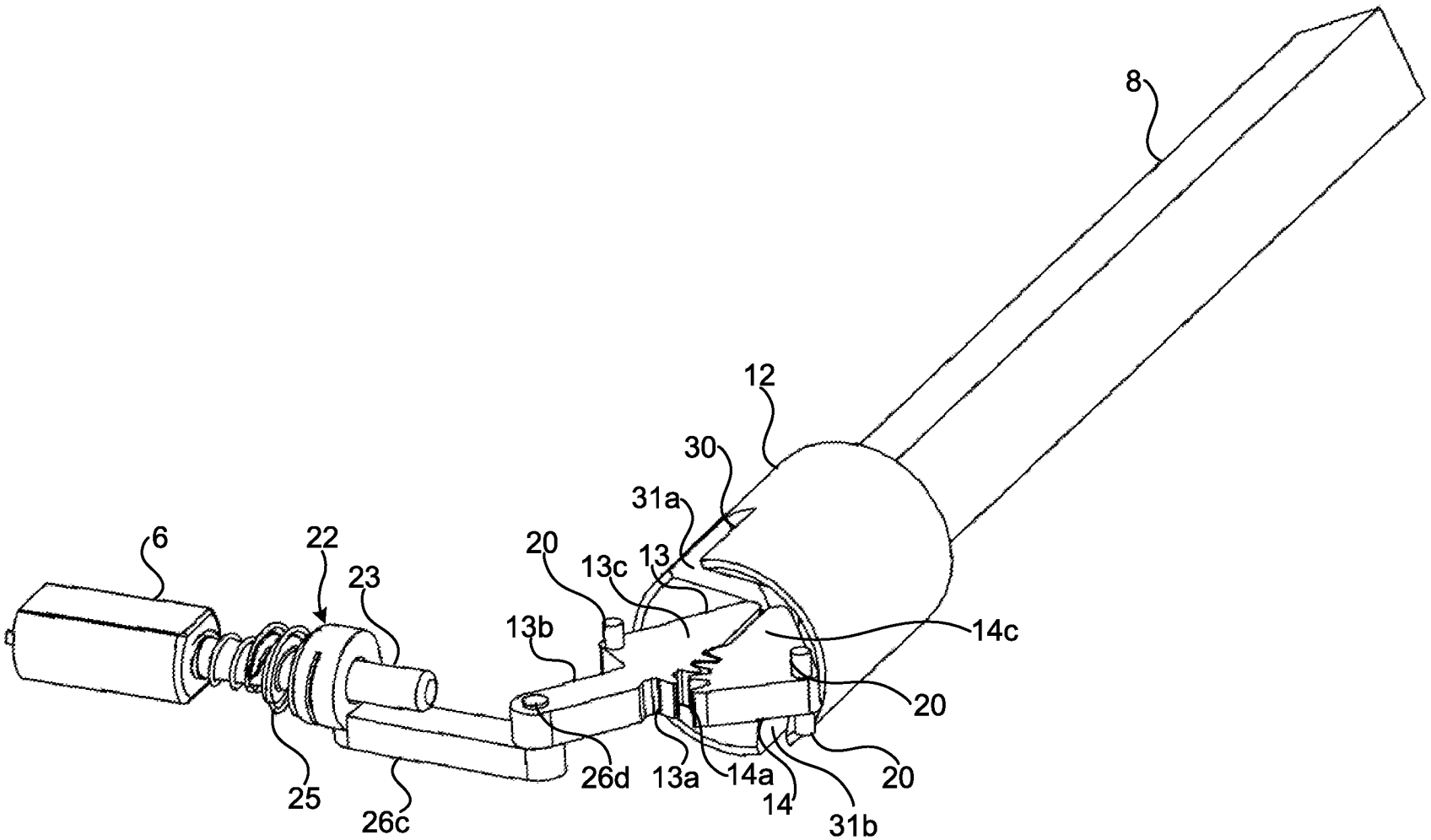
FIG. 2 is a perspective view showing some components more in detail of the handle device shown in FIGS. 1*a* and 1*b*.

The handle device may thus be used for selectively connecting and disconnecting the handle 1 to and from the second element 8 i.e. the plain spindle. FIGS. 2 and 3*a* illustrates the handle device in the disconnected state or mode of operation. At this state, the motor 6 has been rotated in a first direction thereby to displace the drive member 26 towards the motor 6 i.e. to the right as seen in the figures. There by the drive arm 13*b* of the first engagement member 13 has been moved towards the motor 6 and the first engagement member 13 has been pivoted about its pivotal axis in the anti-clockwise direction. The gear engagement between gear teeth 13*a* on the first engagement member 13 and gear teeth 14*a* on the second engagement member has caused the second engagement member to pivot about its pivotal axis in the clock wise direction. Thereby the triangular portions of both engagement members 13, 14 have been pivoted inwards to the position shown in FIGS. 2 and 3*a*. In this release position the engagement members do not extend out passed the central support surface 17*a* and may not extend into slit of the second coupling member 12. The first coupling member 11 and the handle 1 are thereby free to rotate independently of the second coupling member and the second element. This mode of operation thus forms a so called free swing, where actuation or depression of the handle will not influence the second element 8 or any lock bolt or the like connected thereto. The door is thus locked in this mode of operation.

For activating the handle to be operable, a person provided with a correct RFID tag presents the tag to the RFID reader. After verification of the authority of the person the control circuit activates the motor 6 to rotate in the opposite rotational direction. The drive member 26 is thereby moved away from the motor 6, i.e. to the left as seen in the figures, and the first engagement member 13 is pivoted in the clockwise direction. The gear engagement between the gear teeth 13*a*, 14*a*, causes the second engagement member 14 to be simultaneously pivoted in the anti-clockwise direction. Since the handle return means (not shown) has assured that the handle is in the starting position and the support surfaces

17*a*, 17*b*, 18*a*, 18*b* are aligned with the support surfaces 31*a*, 31*b*, 32*a*, 32*b*, the first and second engagement members 13, 14 may be pivotally moved outwards passed the central support surfaces 17*a*, 18*a* and into engagement with the slit 30 formed in the second engagement member 12. In this engagement position, which shown in FIGS. 3*b* and 4, the engagement members 13, 14 are in simultaneous engagement with both the first coupling member and the second coupling member 12 such that a rotational movement of the handle is transmitted to a corresponding rotational movement of the second element 8. Actuation or depression of the handle will thus influence the lock bolt or other device to which the second element 8 is connected thereby to open the door.

The handle device according to the above described embodiment thus provides a simple, space saving and yet reliable means for selectively connecting and disconnecting the handle 1 with and from the second element 8. The pivotal arrangement of the engagement members 13, 14 allows for that the contact surfaces may be large, thereby, in the engagement position, distributing the load to large contact areas and reducing the surface pressure applied to the materials forming the engagement members 13, 14 and the support surfaces 17*a*, 17*b*, 18*a*, 18*b*, 31*a*, 31*b*, 32*a*, 32*b*. By this means the coupling device 10 is capable of transmitting high torques without the risk of wear or failure.

Figure 4:
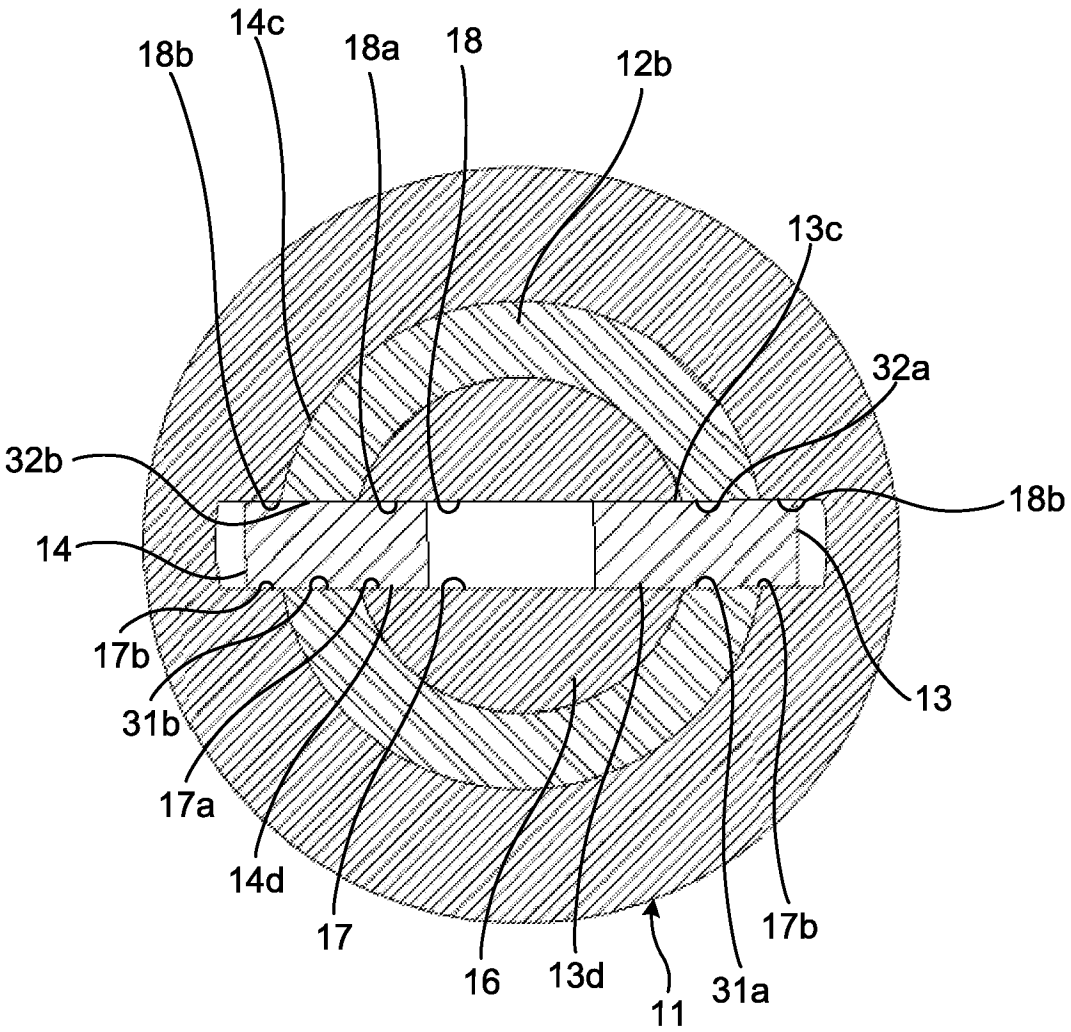
FIG. 4 is a cross section through a coupling device forming part of the handle device shown in FIGS. 1*a-b*.

As best seen in FIG. 4 the embodiment described above entails for a particular advantage in regard of the capability to sustain high torques between the first 3 and second 8 element. The arrangement of having each engagement member 13, 14, in the engagement position, to be supported by two pairs of concentrically arranged support surfaces 17*a*, 17*b* and 18*a*, 18*b* on the first coupling member 11 and a pair of intermediate support surfaces 31*a*, 31*b*, 32*a*, 32*b* arranged at the second coupling member 12 results in a bridging effect between the concentrically arranged inner 17*a*, 18*a* and outer 17*b*, 18*b* support surfaces. A torque applied to the first element 3 and the first coupling member 11, will result in that tangential forces are applied to each engagement member 13, 14 both radially outside and inside the tangential reaction force which is applied tangentially in the opposite direction at the contact between the second coupling member 12 and the engagement member 13, 14. By this means the load on the engagement members 13, 14 is balanced such that the engagement members will not be exposed to any forces striving to tilt or skew the engagement members. Thereby the load will remain distributed over the entire contact surfaces, which reduces the wear. At the same time the maintained orientation of the engagement members will reduce the risk of these members to be jammed or otherwise hindered.

FIGS. 5*a*-6 shows a second embodiment of the invention. At this embodiment the handle device comprises a door handle 101 comprising a grip portion 102 and a first rotational element 103 forming cylindrical neck portion of the door handle. A plain spindle 109 for manoeuvring a door lock or the like is fixed to the first rotational element 103. At this embodiment the second element 112 is stationary and formed as a handle escutcheon which may be non-rotationally fixed to the door. As in the previous embodiment an actuator 122 driven by a motor 106, an electrical control circuit comprising authorisation verification means (not shown) and a battery (not shown) is arranged inside the grip portion 102. The handle device further comprises a coupling device 110 comprising a first coupling member 111, a second coupling member which is constituted by the fixed escutcheon forming the second element 112 and a first 113 and a second 114 engagement member. The first coupling member 111 is formed as an insert comprising two insert halves which are received in and fixed to the first element 103. An axially and radially extending slit is formed between the two insert halves, thereby defining a pair of opposing planar support surfaces 117, 118. The first 113 and second 114 engagement members are pivotally fixed to the first coupling member 111 by cylindrical pivot shafts 120 which are received in respective pivot seats (not shown) arranged in the support surfaces 117, 118. The engagement members 113, 114 each has a planar configuration and comprises a hook portion. The planar side surfaces of the engagement members 113, 114 constitute planar engagement surfaces 113*c*, 113*d*, 114*c*, 114*d* which are arranged to make contact with corresponding support surfaces if the first coupling member 111 and the second coupling member formed by the second element 112. Both engagement members exhibit cooperating gear teeth 113*a*, 114*a* arranged to synchronize the pivotal movement of the engagement members. The first engagement member further comprises a drive arm 113*b* which is connected to a drive member 126 of the actuator 122 by means of a linkage shaft 126*d* received in a cylindrical hole in the drive arm 113*b*.

The second element 112, forming the second coupling member exhibits a cylindrical bore 107 which receives the first coupling member 111. A number of mutually opposing radial slits 130 are arranged such that they extend radially outwards from the bore 109. Each slit defines a pair of opposing planar support surfaces 131*a*, 131*b*.

FIG. 5*a* illustrates the handle device when the coupling device 110 and the engagement members 113, 144 are in the release position. The engagement members 113, 114 are in a inwardly pivoted position whereby the hook portions do not extend outwardly passed the support surfaces 117, 118. Thereby the engagement members do not engage the second stationary element 112 and the handle 101 is freed to rotate together with the first rotational element 103, the first coupling member 111 and the plain spindle 109 in order to manoeuvre a lock or the like (not shown).

For blocking the handle device to thereby lock the door, the motor 106 is activated to rotate in a blocking direction. Such activation may be accomplished simply by pushing a locking button (not shown) on the handle 102. Alternatively locking may require some kind of authorisation, such that a person wanting to change the operational mode of the handle device to the locked state, first needs to present an RFID tag, to enter a security code or the like. Once the motor has been activated to rotate in the blocking direction the drive member 126 will be linearly moved in the direction away from the motor 106, to the left as seen in the figures. This is accomplished in the same way as in the previously described embodiment and is no repeated here. The linear movement of the drive member 126 translated to a clockwise pivotal movement of the first engagement member 113 and, simultaneously, by the gear teeth 113*a*, 114*a* to a anti-clockwise pivotal movement of the second engagement member 114. If the support surfaces 117, 118 are already aligned with corresponding support surfaces 131*a*, 131*b* of any of the slits 130 in the second element 112, the hook portions of the engagement members 113, 114 will immediately enter the corresponding slit 130. To thereby come in simultaneous engagement with both the first coupling member 111 and the second element 112 forming the second coupling member. The handle is thereby blocked from rotation such that it is not possible to rotate the plain spindle 107 for manoeuvring a lock or the like. In case the support surfaces 117, 118 are not aligned with a slit 130 when the motor 106 is driven into the blocking direction, the engaging members 113, 114 will not be able to enter a slit bit will be blocked from outward pivoting by making contact with the inner wall of the bore 109. However, at such instances the driving energy provided by the motor is stored by compression of a spring forming part of the actuator. This compression will urge the drive member and the first and second engagement members 113, 114 towards the blocking position also after the motor has stopped rotating in the blocking direction. As son as the support surfaces 117, 118 and the first 113 and second 114 engagement members are aligned with a respective slit 130, the force exerted by the compressed spring 125 will cause the engagement members 113, 114 to pivot outwards thereby to engage the respective slit 130.

By arranging several pairs of mutually opposing slits 130 in the stationary element 112 it is possible to block the handle relative to the stationary element in a corresponding number of angular positions. By this means the handle and the plain spindle 107 may be blocked in different positions corresponding to different operational modes of e.g. an espagnolette lock allowing a window to be blocked at different degrees of opening or at a so called "dreh kipp" lock which allows a window to be opened by pivoting about different pivotal axes.

When wishing the handle device to resume the release position shown in FIG. 5*a* an authorized person may present a correct authorisation whereby the control circuit will activate the motor 106 to rotate in the release direction thereby to pivotally withdraw the engaging members 113, 114 from engagement with the stationary element 112 thereby to allow rotation of the first coupling member 111, the first element 103, the grip portion 102 and the plain spindle 107.

Also this second embodiment provides a space saving, reliable energy efficient handle device which allows a first element to be selectively engaged and disengaged to and from a second element.

Exemplifying embodiments of the inventive handle device have been described above. The invention is however not limited to these embodiments but may be varied freely within the scope of the appended claims. For example, instead of being provided with a RFID reader, the handle device may have any other suitable means for verifying the authorization of a user. Examples of such means include key pads for entering a code, mechanical or electro-mechanical key cylinders and RF receivers for remote control at a comparatively long distance. Additionally, the number and shape of the engagement members may be varied to a great extent. The handle device may e.g. be provided with a single or multiple pivotal engagement members. In cases where the coupling device comprises two or more engagement members each engagement member may be directly connected to the actuator thereby eliminating the gear teeth for synchronizing their pivotal movement. The actuator may further be varied in a number of different ways, as long as it is capable of causing a pivotal movement of the engagement members or members. The actuator may e.g. comprise a solenoid or a piezo electric component. At some instances the actuator may also be purely mechanic and manually operated.

It is further understood that various aspects of the different embodiments may be added. For example, according to a possible embodiment which has not been illustrated or described above, the handle device may comprise a first rotational element and two second elements, one of which is stationary and one of which is rotational. The coupling device may then comprise a first coupling member which is connected to the first element and two second coupling members that are connected to a respective one of the stationary and the rotational second elements. The coupling arrangement may then comprise one or several pivotal engagement members which, in a first operational position is in engagement with the first coupling member and the second coupling member being connected to the stationary element but out of engagement with the second coupling member being connected to the rotational second element. In such an operational position, the first element is thus locked relative to the stationary second element and the rotational second element is free swinging in relation to the first element and the stationary second element. When the engagement member has been displaced to a second operational position, it may be in engagement with the first coupling member and the second coupling member being connected to the rotational second element but out of engagement with the second coupling member being connected to the stationary second element. In this operational position, the first element may be rotated and its rotational movement is transmitted to the second rotational element for effecting an operational movement of a lock bolt or any other lock component or arrangement being connected to the second rotational element.

The invention claimed is:

1. A handle device for operating doors and windows, the handle device comprising a first element, which is rotatable about an axis of rotation, a second element, and a coupling device, which is arranged to selectively allow and prevent relative rotation about the axis of rotation between the first and second elements, the coupling device comprising:

a first coupling member being connected to or forming an integral part of the first element, a second coupling member being connected to or forming an integral part of the second element, two engagement members, which are pivotally movable between corresponding engagement positions in which each of the engagement members simultaneously engage the first and the second coupling members to thereby prevent relative rotation about the axis of rotation between the first and second element, and corresponding release positions, in which each of the engagement members are disengaged from at least one of the first and second coupling members to thereby allow relative rotation about the axis of rotation between the first and second elements, and an actuator which is arranged to pivotally move the engaging members between their corresponding engagement positions and their corresponding release positions, wherein each of the engaging members are pivotally mounted to the first coupling member and arranged to pivotally move between the corresponding engagement positions and the corresponding release positions, and wherein the two engagement members which are mutually interconnected by gear engagement between gear teeth on a first one of the engagement members and gear teeth on a second one of the engagement members for synchronized pivotal movement between the corresponding engagement positions and the corresponding release positions.

2. The handle device according to claim 1, wherein the second coupling member is received concentrically in the first coupling member.

3. The handle device according to claim 2, wherein the first coupling member comprises a radially located inner portion and a radially located outer portion and wherein at least a portion of the second coupling member is received between said radially located inner and outer portions.

4. The handle device according to claim 1, wherein the first coupling member is received concentrically in the second coupling member.

5. The handle device according to claim 1, wherein each of the two engagement members exhibits two planar engagement surfaces, each engagement surface being arranged, in the engagement position, to make contact with at least one planar support surface of the first coupling member and at least one planar support surface of the second coupling member.

6. The handle device according to claim 5, wherein the planar engagement surfaces, the at least one planar support surfaces of the first coupling member, and the at least one planar support surface of the second coupling member are arranged parallel when the two engagement members are in their engagement positions.

7. The handle device according to claim 1, wherein the first coupling member and the second coupling member are rotationally symmetrical.

8. The handle device according to claim 1, wherein the actuator is a linear actuator and is connected to at least one of the two engagement members by a mechanical linkage arranged to translate a linear movement of the actuator to a pivotal movement of the at least one of the two engagement members.

9. The handle device according to claim 8, wherein the actuator comprises a drive unit chosen from the group of an electrical motor, a solenoid, and a piezo electric element.

10. The handle device according to claim 1, wherein the second element is rotational and comprises or is connected to a spindle for maneuvering a lock.

11. The handle device according to claim 1, wherein the second element is stationary and comprises or is connected to a handle escutcheon.

* * * * *